US008091822B2

(12) United States Patent
Boyce

(10) Patent No.: US 8,091,822 B2
(45) Date of Patent: Jan. 10, 2012

(54) AERIAL IMAGE PROJECTION SYSTEM AND METHOD OF UTILIZING SAME

(76) Inventor: Mark A. Boyce, Gilbert, AZ (US)

( * ) Notice: Subject to any disclaimer, the term of this patent is extended or adjusted under 35 U.S.C. 154(b) by 838 days.

(21) Appl. No.: 12/140,548

(22) Filed: Jun. 17, 2008

(65) Prior Publication Data

US 2008/0313937 A1 Dec. 25, 2008

Related U.S. Application Data

(60) Provisional application No. 60/945,171, filed on Jun. 20, 2007.

(51) Int. Cl.
*A63H 27/00* (2006.01)

(52) U.S. Cl. ... 244/13; 244/153 R; 244/154; 244/155 R; 40/212

(58) Field of Classification Search ..... 244/153 R, 244/154, 155 R, 900–904; 40/212, 214
See application file for complete search history.

(56) References Cited

U.S. PATENT DOCUMENTS

| | | | | |
|---|---|---|---|---|
| 2,592,444 | A * | 4/1952 | Matelena | 353/13 |
| 4,424,945 | A * | 1/1984 | Dell | 244/13 |
| 4,859,053 | A * | 8/1989 | Nicolas | 353/74 |
| 4,930,724 | A * | 6/1990 | Snyder | 244/13 |
| 4,934,630 | A * | 6/1990 | Snyder | 244/13 |
| 6,749,154 | B1 | 6/2004 | Johnson | |
| 6,870,673 | B2 * | 3/2005 | Cromer et al. | 359/450 |
| 6,929,221 | B2 | 8/2005 | Preston | |
| 7,204,049 | B2 | 4/2007 | Herbert | |
| 7,315,241 | B1 * | 1/2008 | Daily et al. | 340/525 |
| 7,341,351 | B2 * | 3/2008 | Halmi et al. | 353/13 |
| 7,611,396 | B2 * | 11/2009 | Schnuckle | 446/220 |
| 7,791,799 | B1 * | 9/2010 | Lejeune et al. | 359/443 |
| 2002/0171927 | A1 * | 11/2002 | Barnes, III | 359/451 |
| 2003/0032426 | A1 * | 2/2003 | Gilbert et al. | 455/427 |
| 2004/0141162 | A1 * | 7/2004 | Olbrich | 353/119 |
| 2005/0162736 | A1 * | 7/2005 | Cromer et al. | 359/450 |
| 2005/0219479 | A1 * | 10/2005 | Mugrauer | 353/122 |
| 2005/0247819 | A1 * | 11/2005 | Caruso | 244/2 |
| 2006/0104070 | A1 * | 5/2006 | Carito | 362/398 |

OTHER PUBLICATIONS

Airshow 4000, Product Catalog—Business and Regional, Rockwell Collins, downloaded Jun. 4, 2008, http://www. rockwellcollins.com/ecat/br/Airshow_4000.html?smenu=113 .

* cited by examiner

*Primary Examiner* — Tien Dinh
*Assistant Examiner* — Justin Benedik
(74) *Attorney, Agent, or Firm* — Meschkow & Gresham, P.L.C.

(57) ABSTRACT

An aerial image projection system (20) includes a light aircraft (22) having a parachute-wing (24) attached to a carriage (26). The system (20) further includes an on-board computing and projection unit (30) with an image projector (32) coupled to the carriage (26) and suspended below the parachute-wing (24). An image display process (98) utilizing the system (20) entails generating (100) still and/or moving images (34) in a digital format for management by the computing and projection unit (30) and projecting (102) those images (34) from the projector (32) onto the parachute-wing (24). The projection of particular images (34) may be governed by time of day, particular events, current location of aerial image projection system (20) as detected by a navigational system receiver (66) of the unit, and so forth.

20 Claims, 6 Drawing Sheets

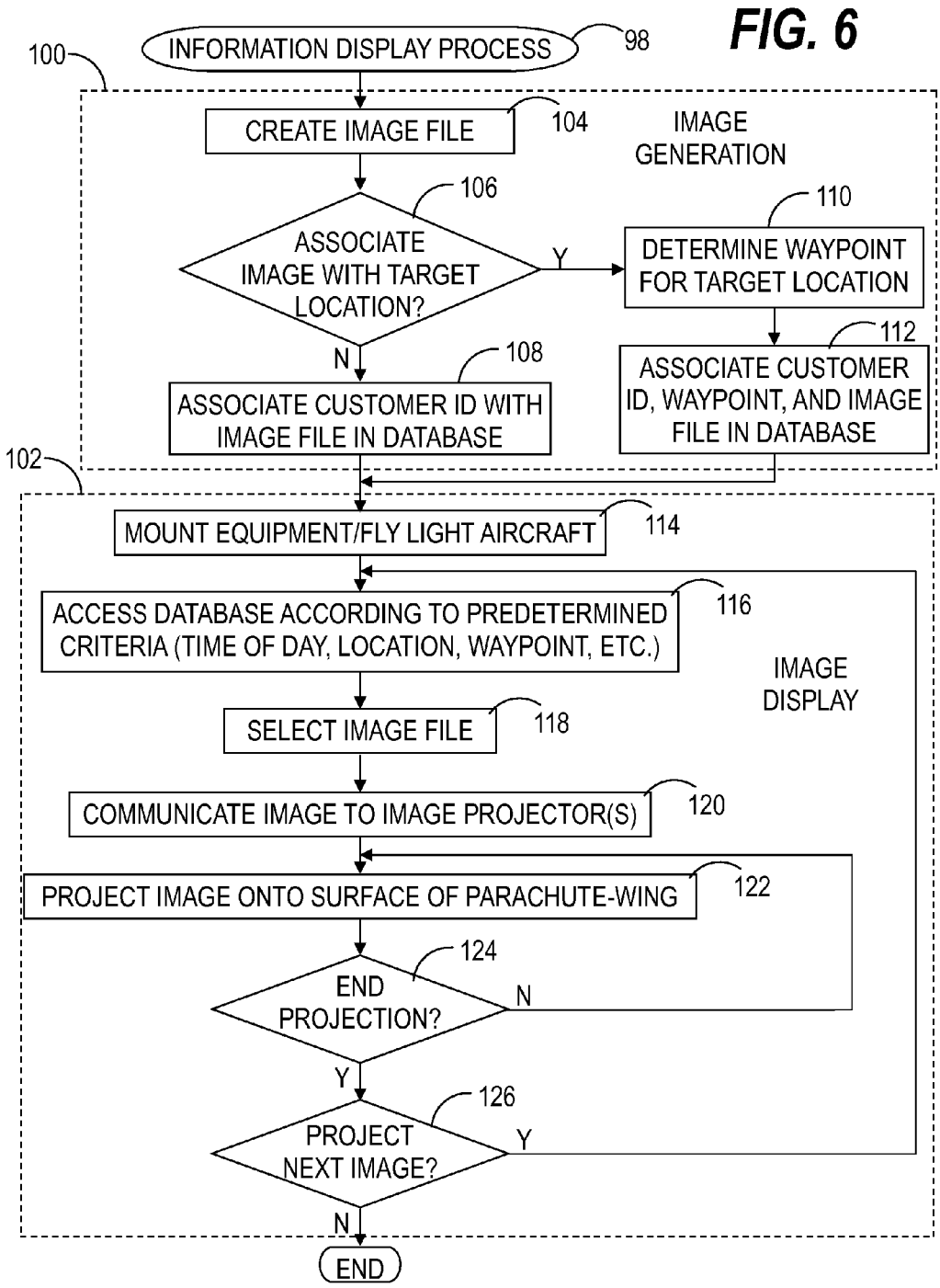
FIG. 6
INFORMATION DISPLAY PROCESS
98
100
CREATE IMAGE FILE
104
IMAGE GENERATION
106
ASSOCIATE IMAGE WITH TARGET LOCATION?
Y
110
DETERMINE WAYPOINT FOR TARGET LOCATION
N
108
ASSOCIATE CUSTOMER ID WITH IMAGE FILE IN DATABASE
112
ASSOCIATE CUSTOMER ID, WAYPOINT, AND IMAGE FILE IN DATABASE
102
MOUNT EQUIPMENT/FLY LIGHT AIRCRAFT
114
ACCESS DATABASE ACCORDING TO PREDETERMINED CRITERIA (TIME OF DAY, LOCATION, WAYPOINT, ETC.)
116
IMAGE DISPLAY
SELECT IMAGE FILE
118
COMMUNICATE IMAGE TO IMAGE PROJECTOR(S)
120
PROJECT IMAGE ONTO SURFACE OF PARACHUTE-WING
122
124
END PROJECTION?
N
Y
126
PROJECT NEXT IMAGE?
Y
N
END

AERIAL IMAGE PROJECTION SYSTEM AND METHOD OF UTILIZING SAME

RELATED INVENTIONS

The present invention claims priority under 35 U.S.C. §119 (e) to: "Ram-Air Airfoil Projection and Waypoint Advertising System," U.S. Provisional Patent Application Ser. No. 60/945,171, filed 20 Jun. 2007, which is incorporated by reference herein.

TECHNICAL FIELD OF THE INVENTION

The present invention relates generally to information display systems and methodology. More specifically, the present invention relates to an aerial image projection system for broadcasting images.

BACKGROUND OF THE INVENTION

Aerial advertising has been utilized for many years. Aerial advertising systems include skywriting, signs and logos on the sides of dirigibles, parachutists with indices on their canopies or having banners suspended from them during flight, and banners towed behind fixed-wing airplanes or suspended from slower moving aircraft such as helicopters, dirigibles, and balloons. Aerial advertising displays can be seen by many people at gatherings such as outdoor concerts, sporting events, carnivals, shows, celebrations, and by other members of the public outdoors, such as at the beach, park, in the city, or just walking around the streets.

Unfortunately, conventional aerial advertising systems suffer from a number of problems. For example, banners towed behind airplanes need to be relatively long and thin to minimize the drag to the airplane. Thus, many airplane banners are single line messages in plain font with little or no space to display flags, logos, devices, or signs. In addition, the high air speed of airplanes means that the message being displayed is not in the field of view of most spectators for very long. Furthermore, the use of fixed-wing airplanes is costly and they generally have restricted corridors in which the can fly over cities further limiting the time in which the advertising display is in the field of view of spectators.

Slower moving aircraft such as helicopters and airships are often allowed greater access to airspace over cities. These slower moving aircraft are more maneuverable and are often able to be better positioned for viewing by spectators. Furthermore, the lower airspeed of the aircraft enables the aircraft and hence the advertising display to stay in the field of view of spectators for greater lengths of time. Unfortunately, the amount of work and planning to fabricate a banner, flag, parachute canopy, airship skin, airfoil, and the like is complicated and expensive. That is, artwork, images, photographs, and verbiage must be applied onto the surface of the canopy, airship skin, or airfoil by stitching, silk-screening, airbrushing, and/or painting. The time to accomplish such a process can vary between many hours to many months. Furthermore, once it is complete, the applied artwork, images, photographs, and verbiage simply cannot change, are limited in creativity, and cannot be seen at night. Hence, these conventional aerial advertising techniques have limited appeal in the advertising markets.

Some airships or other inflatable structures have utilized airship displays, such as computerized electronic display or light boards which may be mounted on one or each side of the airship. These airships tend to draw spectator attention and are very memorable. Thus, they can serve as effective advertising tools. The display or light board systems typically utilize hundreds of lamps or light-emitting diodes (LEDs) which are turned on or off to create the desired image. In some instances, this process has been automated using computer programs to display corporate logos, messages, and simple animations. In other display systems, the lamps or LEDs are replaced with end-lit fiber optic cables arranged in a matrix and individually illuminated to produce a pixel-like image or display. Unfortunately, these systems utilize a large matrix of light emitting devices (LEDs or fiber optic cables). Consequently, they are not acceptable for real-time or pre-recorded video projection. Rather, they are more suitable for use in displaying stationary graphics and scrolled text. Furthermore, the weight of the lamps, cabling, and other onboard electronic components limit the projection display area and make these systems very heavy. Moreover, the operation of these aerial display devices is prohibitively expensive for many businesses.

Therefore, what is needed is a system and method for the aerial display of information content that draws spectator attention, can display a variety of still and moving images, is versatile, readily implemented, and cost effective.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 6 illustrates a flowchart of an aerial projection process utilizing the aerial image projection system.

DETAILED DESCRIPTION

An embodiment entails an aerial image projection system for the aerial display of information content that draws spectator attention, that can display a variety of still and moving images, is versatile, and is readily implemented. Another embodiment entails a method for projecting an image utilizing the aerial image projection system that enables businesses and individuals to disseminate information in an affordable manner. The aerial image projection system and associated methodology may be utilized for the purpose of aerial advertising. However, it will become apparent in the ensuing discussion that the system and method may be utilized for other purposes including, but not limited to, personal text and picture messaging, video feeds of events or terrain, entertainment, search and rescue operations, and any other purpose for which a customer may desire an aerial display of information content. In addition, the system and methodology may be utilized to allow for the information content to change according to a geographical location of the aerial image projection system.

Figure 1:
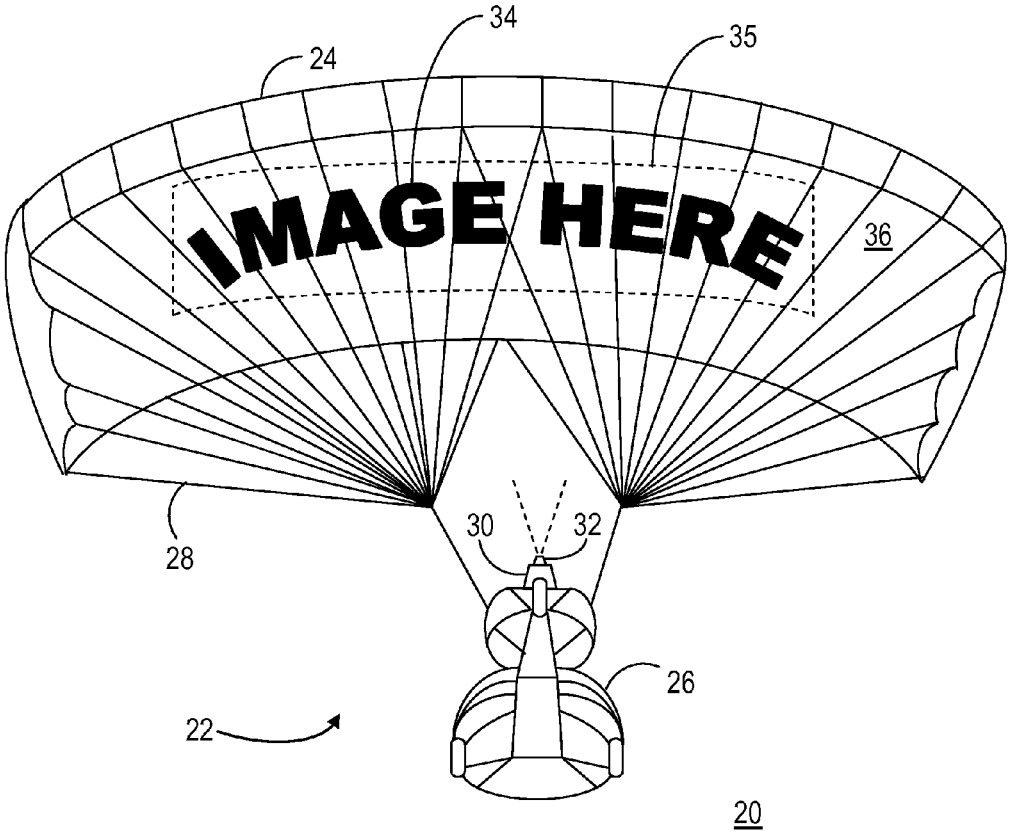
FIG. 1 illustrates a perspective view of an aerial image projection system in accordance with an embodiment of the invention.

FIG. 1 illustrates a perspective view of an aerial image projection system 20 in accordance with an embodiment of the invention. Aerial image projection system 20 includes a light aircraft 22 having a parachute-wing 24 attached to a carriage 26 by support lines 28. Aerial image projection system 20 further includes an on-board projection and computing unit 30. Projection and computing unit 30 includes an image projector 32 suspended below parachute-wing 24, and more particularly, mounted to carriage 26. Image projector 32 projects an image 34 onto a predetermined location 35 of a surface 36, and more specifically, an earth facing surface of parachute-wing 24 while light aircraft 22 is flying. Image 34 can be any of a variety of still and moving images. For example, image 34 may be a company logo, a still picture, text, a moving cartoon, a video recording, a webpage, and the like.

In an embodiment, light aircraft 22 is a powered parachute, also referred to as a motorized parachute, PPC, paraplane, and the like. In general, a powered parachute is a parachute with a motor and wheels. Such an aircraft has an airspeed of approximately 25-35 miles per hour (40-60 kilometers per hour). Powered parachutes operate safely at heights ranging from a few feet above the ground to altitudes as high as eighteen thousand feet. However, typical operating heights are between five hundred and fifteen hundred feet. Equipped with a standard five to ten gallon fuel tank, powered parachutes can typically be flown for approximately three hours. They have very short take-off and landing rolls, sometimes less than one hundred feet, and they are among the least expensive aerial vehicles.

In the United States, two-place powered parachutes are classified by the Federal Aviation Administration (FAA) as light sport aircraft. Aircraft which qualify as light sport aircraft may be operated by holders of a sport pilot certificate. Pilots with a private, recreation, or higher pilot certificate license may also fly light sport aircraft. Powered parachute pilots typically enjoy flying "low and slow," and the powered parachute is considered an excellent platform for sightseeing and photography. Powered parachutes are also used in agriculture, in the military, and by law enforcement agencies and flight search and rescue organizations.

In the United States, the FAA implemented the Sport Pilot rule in 2004 which expanded the range of venues in which powered parachutes can legally fly. Indeed, a properly equipped powered parachute may be flown at night and/or over metropolitan areas by a private pilot with a powered parachute rating. Consequently, light aircraft 22 in the form of a powered parachute can now by flown by a qualified pilot in areas that are likely to have a large number of spectators, such as at outdoor concerts, sporting events, carnivals, shows, celebrations, and other outdoor public areas, such as at the beach, park, and in the city. Light aircraft 22 will be referred to herein as light aircraft 22 or as powered parachute 22.

Parachute-wing 24 is a "ram-air" airfoil, also know as a parafoil. Typical of ram-air parafoils, parachute-wing 24 has two layers of fabric, top and bottom, connected by airfoil-shaped fabric ribs that form "cells." They can also include "stiffeners" of plastic or mylar sheets sewn onto the ribs to mitigate the problem of deformation due to head-on wind. The cells fill with high pressure air from vents that face forward on the leading edge of parachute-wing 24, and the ballooning fabric inflates into an airfoil shape. The bottom layer of fabric of parachute-wing 24 forms surface 36 upon which image 34 is projected.

A conventional parachute-wing 24 is approximately forty by thirteen feet (approximately twelve by four meters), and image 34 may be projected over all or a majority of surface 36 of parachute-wing 24. Thus, image 34 projected largely over an entirety of surface 36 is highly visible from five hundred to one thousand feet (approximately one hundred and fifty to three hundred meters) above the ground. The visibility of image 34 is enhanced when image 34 is viewed at night, although nighttime viewing is not a requirement. Although a forty by thirteen foot parachute-wing is mentioned herein, such a dimension and shape is not a requirement of the present invention. In alternative embodiments, various other dimensions and shapes of parachute-wings may be employed.

Figure 2:
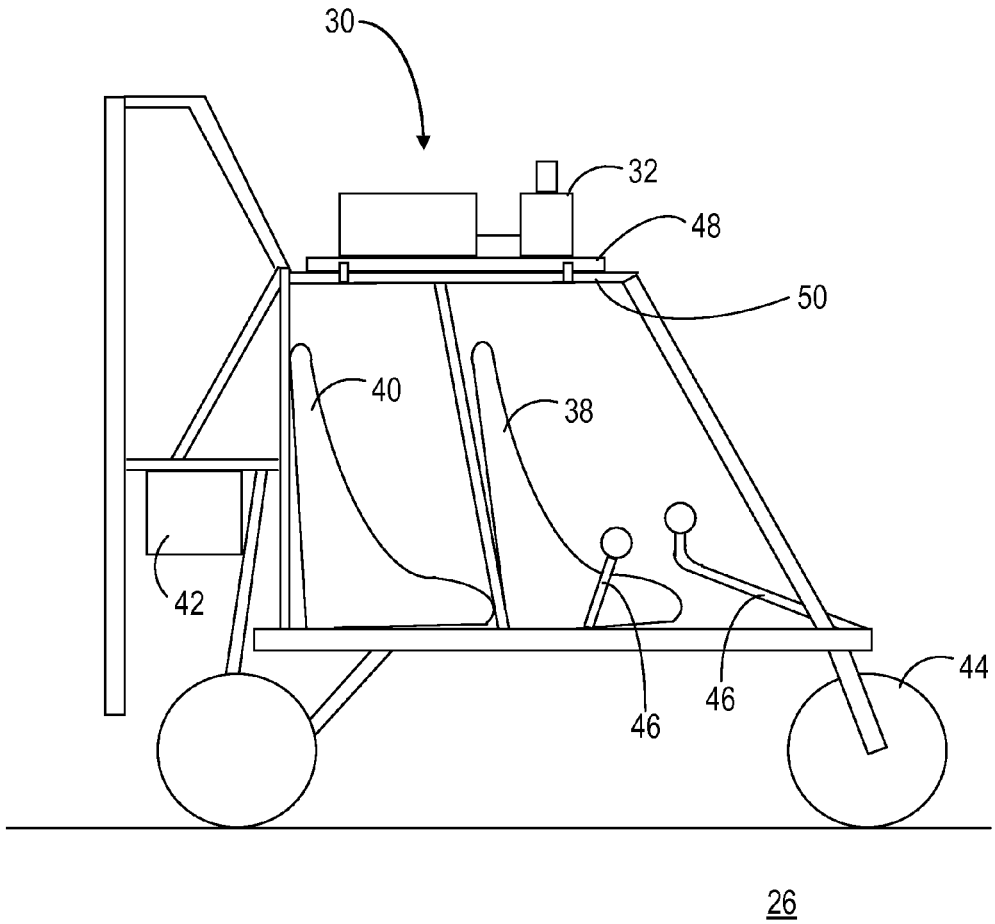
FIG. 2 illustrates a side view of a carriage of a powered parachute of the aerial image projection system.

FIG. 2 illustrates a side view of carriage 26 of powered parachute 22 (FIG. 1) of aerial image projection system 20 (FIG. 1). Carriage 26 includes a seat 38 for the pilot. Carriage 26 may optionally include another seat 40 for a passenger. On-board projection and computing unit 30 may be controlled by the pilot, the passenger, or both the pilot and passenger. Carriage 26 additionally includes an engine and fuel tank 42, a propeller (not visible), a tricycle undercarriage 44, and pilot controls 46. Of course, those skilled in the art will recognize that carriage 26 may include other components not specified herein for brevity.

A support structure 48 is attached to top struts 50 of carriage 26, and projection and computing unit 30 is coupled to support structure 48. In an embodiment, support structure 48 may be coupled to top struts 50 that are located above seats 38 and 40. Top struts 50 are shown as being generally horizontal for simplicity. However, those skilled in the art will recognize that top struts 50 may have a slight slope toward the ground in front of carriage 26. Thus, support structure 48 with the attached projection and computing unit 30 is located above the pilot's and passenger's heads. Support structure 48 may be a universal or adjustable mounting type system so that support structure 48, with the previously attached projection and computing unit 30, may be readily installed before flight and removed (if need be) after flight. A universal or adjustable mounting type support structure 48 can enable structure 48 to be relocated on different light aircraft 22 with relative ease. Although support structure 48 is shown as being attached to top struts 50, in alternative embodiments, all or a portion of on-board projection and computing unit 30 (e.g., image projector 32) may be coupled to a "boom" extending from the front, rear, or either side of carriage 26.

Image projector 32 may be coupled to support structure 48 in a fixed position. Alternatively, support structure 48 may include a conventional variable position mounting system that allows for three dimension adjustments, for example, roll, yaw, and pitch, and has position memory so as to maintain image projector 32 in a predetermined position while airborne. The variable position mounting system allows a user to selectively direct image 34 (FIG. 1) to predetermined location 35 (FIG. 1) on surface 36 of parachute-wing 24.

Figure 3:
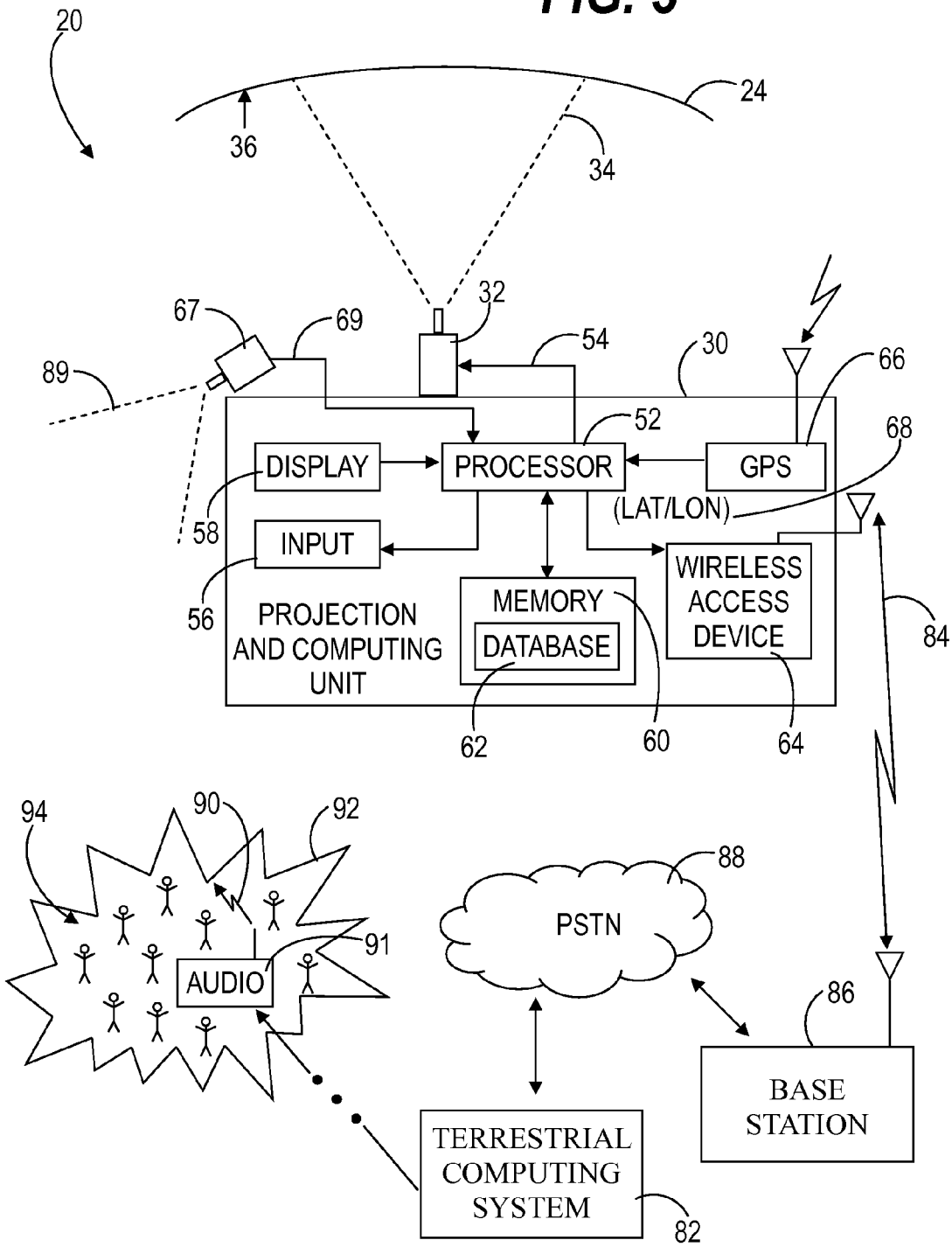
FIG. 3 illustrates a block diagram of the aerial image projection system.

FIG. 3 illustrates a block diagram of aerial image projection system 20. As mentioned briefly above, along with powered parachute 22 (FIG. 1), aerial image projection system 20 includes projection and computing unit 30 with image projector 32 for projecting image 34 onto surface 36 of parachute-wing 24. Projection and computing unit 30 includes various components that may be housed in a single case or may be housed in multiple cases. Projection and computing unit 30 includes a processor 52 in communication with image projector 32 via a data channel 54. Processor 52 is further in communication with an input device 56, a display 58, a memory element 60 for storage of a database 62, a wireless access device 64, and a navigational system receiver (GPS) 66. In some embodiments, projection and computing unit 30 may further include a video camera 67 having a video output 69 in communication with processor 52. These elements may be interconnected by a bus structure and/or discrete cables. For example, processor 52, input device 56, display 58, memory element 60, and wireless access device 64 may form some of the components of a conventional laptop computer, or some other portable computing device. Navigational system receiver 66 may then plug into the laptop computer or may be built into the laptop computer.

Projector 32 may be a digital projector that takes a still or motion video signal and projects the corresponding image 34 onto a projection screen, in this case parachute-wing 24, using a lens system. Video projectors typically use a very bright light to project the image, and most current projectors can correct curves, blurriness, and other inconsistencies through manual settings. Projector 32 desirably provides sufficient light, for example, over approximately three thousand lumens, to adequately project image 34 onto parachute-wing 24. Projector 32 may be realized using one of various known and upcoming projection technologies, such as a cathode ray tube projection, liquid crystal display projection, digital light processing front projection, liquid crystal on silicon projection, laser projection, and so forth.

Input device 56 can encompass a keyboard, mouse, pointing device, audio device (e.g., a microphone), and/or any other device providing input to processor 52. In one embodiment, the pilot or passenger may view control information in the form of computer software on display 58 and may subsequently enter commands via input device 56.

Navigational system receiver 66 may be a global positioning system (GPS) receiver. As is well known in the art, GPS includes a network of satellites that continuously transmit precise digital radio signals that enable a GPS receiver, i.e., navigational system receiver 66, to determine its location, speed, direction, and time. By using the signals from, for example, three satellites, navigational system receiver 66 can calculate its current latitude and longitude, and by using the signals from, for example, four satellites, navigational system receiver 66 can additionally calculate its altitude. Navigational system receiver 66 provides a waypoint 68 to processor 52 indicating the current location of navigational device 66, hence the current location of aerial image projection system 20. As known to those skilled in the art, a waypoint is a specific geographic location typically provided as a set of coordinates that include latitude and longitude. In one embodiment, processor 52 can access database 62 to select a particular image 34 (FIG. 1) for projection when the current location, as indicated by waypoint 68, of system 20 is at a target location (discussed below) at which image 34 is to be projected.

Figure 4:
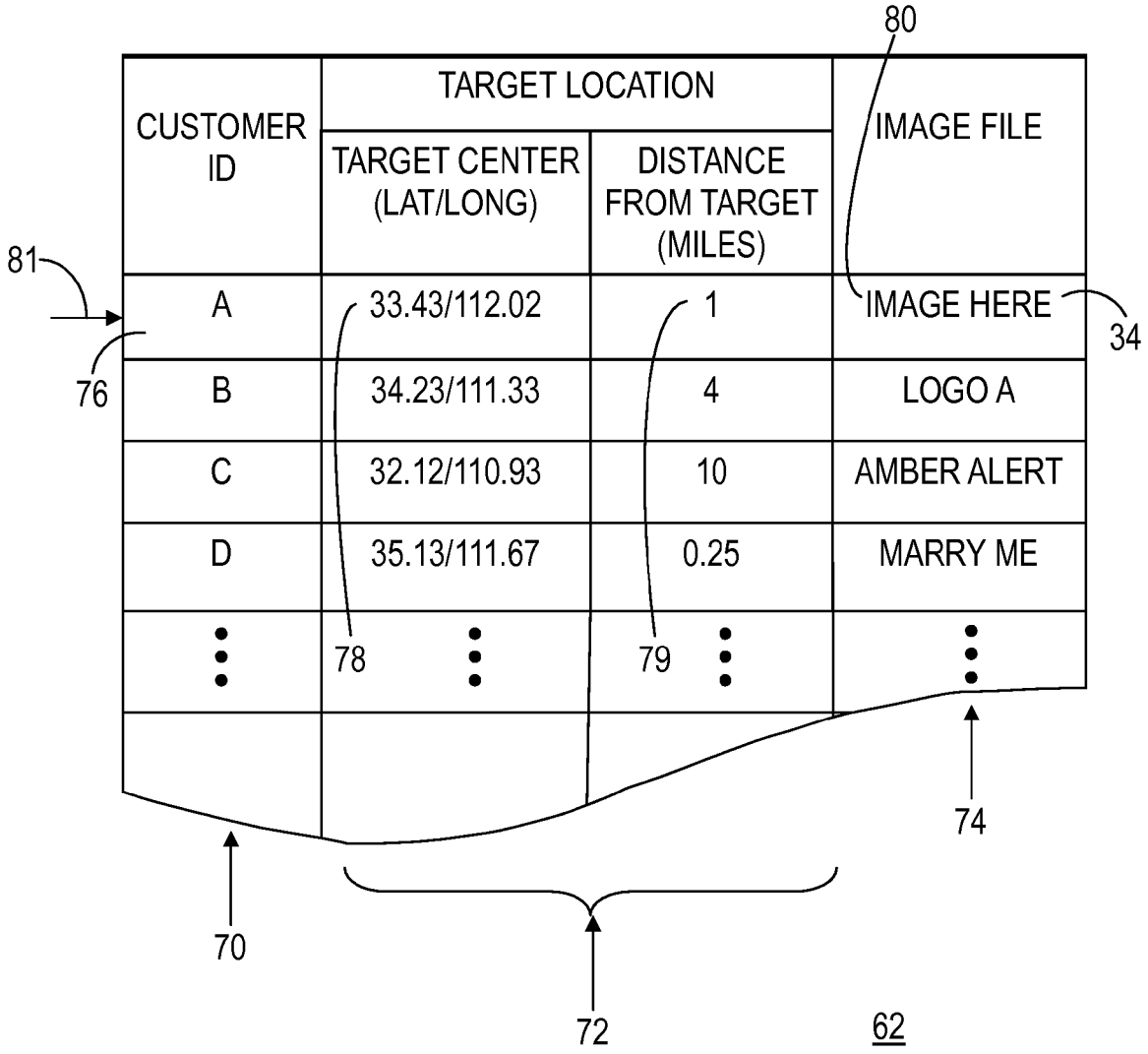
FIG. 4 illustrates a database utilized with the aerial image projection system in one embodiment of the invention.

Referring to FIG. 4 in connection with FIG. 3, FIG. 4 illustrates database 62 utilized with aerial image projection system 20 in one embodiment of the invention. Customers may engage in a prearranged agreement in which image content to be projected onto surface 36 of parachute-wing 24 can change in accordance with the geographic location of aerial image projection system 20. For example, while flying within a predetermined distance of a subscribed customer, image 34 being displayed on parachute-wing 24 can relate to that customer. Similarly, a customer may define other geographic or demographic locations that meet certain predetermined criteria at which the customer wishes to have image 34 displayed on parachute-wing 24. Such predetermined criteria may be over groups of a specific size or in a specific region, e.g., sporting events, festivals, fairs, traffic jams, or other events that meet the customer's demographic requirements. This feature is referred to herein as a waypoint information display service.

In an embodiment, database 62 includes a listing of customers subscribed to the waypoint information display service. For example, database 62 includes a customer identifier field 70, a target location field 72, and an image file field 74. Customer identifier field 70 includes a list of customer identifiers 76 associated with customers subscribed to the waypoint information display service. Each customer identifier 76 has associated therewith one or more target locations listed in target location field 72, at which image content is to be displayed, and one or more image files 80 or pointers to image files 80 in image file field 74 representing image content to be displayed at the target location. In one embodiment, target location field 72 may specify a target center point 78 and a radial distance 79 from target center point 78. The combined information of target center point 78 and radial distance 79 from target center point 78 defines a particular geographic area, i.e., the target location, over which image content is to be displayed. Thus, as shown, a row 81 in database 62 includes customer identifier 76, target center point 78, distance 79, and image files 80 or pointers to image files 80 for a given customer. Those skilled in the art will recognize that database 62 can take on various forms and can include more or less information than that which is shown.

With continued reference to FIGS. 3 and 4, in accordance with a waypoint information display service, navigational system receiver 66 provides waypoint 68 to processor 52 indicating a current location of aerial image projection system 20. Processor 52 then accesses database 62 to select image 34 for projection when the current location indicated by waypoint 68 corresponds to a target location, i.e., one of waypoints 78 in database 62. For example, waypoint 68 may indicate that the current location of aerial image projection system 20 is within a certain distance of a target location, i.e., one of waypoints 78 in database 62. In such a scenario, image 34 is projected onto parachute-wing 24 within an area defined by the target location in order to direct particular image content to a desired audience. That is, processor 52 can autonomously display image 34 stored in database 62 on parachute-wing 24 based on the current latitude and longitude, i.e., waypoint 68, of aerial image projection system 20 in flight and without operator interaction.

Referring back to FIG. 3, wireless access device 64 is a component, such as a personal computer (PC) card, laptop card, or universal serial bus (USB) equipment, that employs wireless broadband technology in order to allow broadband connection between processor 52 to the Internet via a wireless network. In this exemplary scenario, processor 52 of on-board projection and computing unit 30 may communicate with a terrestrially-based portion of aerial image projection system 20. The terrestrially-based portion of system 20 includes a terrestrial computing system 82. Communication between processor 52 and terrestrial computing system 82 can occur via a wireless channel 84 to a cellular base station 86 and subsequently through the public switched telephone network (PSTN) 88. Although a cellular wireless network is shown herein, in an alternative embodiment, the wireless network may be a satellite-based network and wireless access device 64 allows broadband connection between processor 52 to the Internet via a satellite network. Terrestrial computing system 82 and on-board projection and computing unit 30 may employ virtual private networking (VPN) techniques to provide secure communication between system 82 and unit 30 using cellular base station 86 and PSTN 88. The VPN techniques can be hardware based, firewall based, software based, or some combination thereof.

Terrestrial computing system 82 may be managed by a business entity that is providing an information display service. Terrestrial computing system 82 may have a number of functions including, but not limited to, remote control of on-board projection and computing unit 30, upload of image 34 from terrestrial computing system 82 to projection and computing unit 30, download of still or moving pictures from camera 67 to terrestrial computing system 82, and so forth. In a remote control process, an on-ground "producer" may log into on-board projection and computing unit 30 from terrestrial computing system 82 to manipulate information content, such as image 34, to be displayed on parachute-wing 24. This "remote control" can be accomplished utilizing known and upcoming software programs that accomplish real-time network mirroring of display 58 of on-board projection and computing unit 30 onto terrestrial computing system 82, so that on-board projection and computing unit 30 can be controlled from terrestrial computing system 82.

Terrestrial computing system 82 may additionally be used to manage a website that allows for customer interactivity with aerial image projection system 20. In order to make image content or customer advertisements more appealing one approach is to enable the upload of custom messages, text messaging, pictures, and the like through the website managed by terrestrial computing system 82. For example, a customer can use his or her computer, cell phone, personal digital assistant, and so forth to upload a picture or message that may be displayed on parachute-wing 24 alone or in conjunction with a primary advertiser.

As mentioned briefly above, some embodiments may include video camera 67 having a video output 69 in communication with processor 52. Video camera 67 may be utilized to record still or moving video pictures 89 of a particular location or individuals over which aerial image projection system 20 is flying. Video pictures 89 may be may stored or recorded in video camera 67 and/or on on-board projection and computing unit 30. Alternatively, video pictures 89 from video camera 67 may be downloaded to terrestrial computing system 82. Video camera 67 is desirably mounted on a known or upcoming camera stabilizing mount to limit the effect of vehicular motion on the operation of video camera 67.

In some embodiments, aerial image projection system 20 may include means, in the form of an audio source, generally represented by an item 91, for providing audio 90 at a target location 92 to a target audience 94 correlated with the projection of image 34. Since powered parachute 22 (FIG. 1) is able to fly at such low altitudes, audio source 91 for providing audio 90 can entail audio tracks such as music and spoken words that can be played from on-board projection and computing unit 30 for audience 94 on the ground at location 92. Audio source 91 may alternatively be provided by terrestrially-based audio systems through broadcast AM, FM, satellite-based radios, digital radios, television, and the like that can provide audio 90. In yet another embodiment, audio source 91 could be from a ground-based vehicle with stereo equipment that broadcasts the audio correlated with projection of image 34. By way of example, aerial image projection system 20 may be flown above a parking lot of a large complex of movie theaters, and image 34 may be a video movie preview. Audience 94 could then listen to audio 90 for the movie preview as it is being projected onto parachute wing 24. In another example, an advertisement may be visually displayed on parachute-wing 24 simultaneously with a radio advertisement being broadcast over a particular AM, FM, satellite, or digital radio station or via a television signal.

Figure 5:
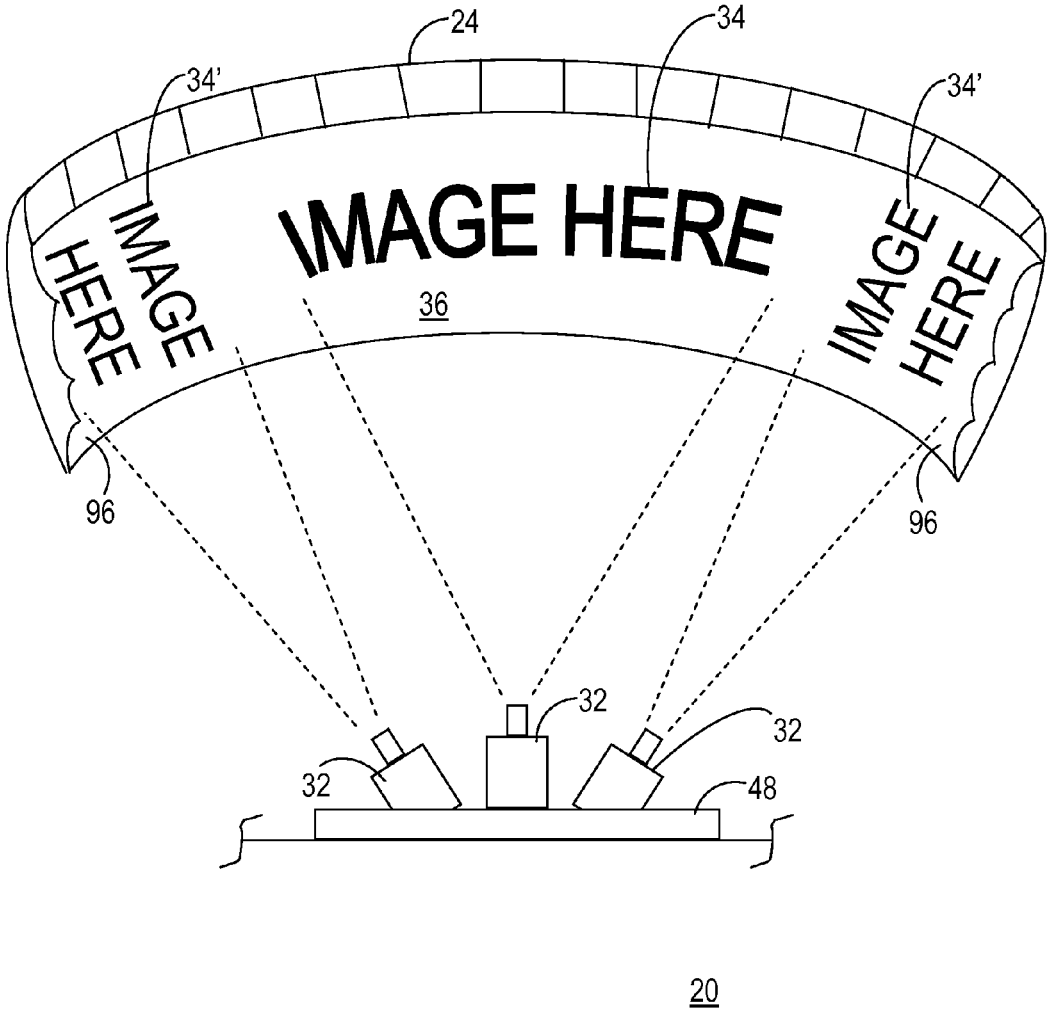
FIG. 5 illustrates a partial perspective view of the aerial image projection system in accordance with another embodiment of the invention.

FIG. 5 illustrates a partial perspective view of aerial image projection system 20 in accordance with another embodiment of the invention. In the embodiment shown in FIG. 1, single projector 32 is utilized to project image 34. However, in other embodiments, multiple projectors 32 may be utilized. As shown in FIG. 5, three projectors 32 are utilized to project image 34. Multiple projectors 32 allow the identical image 34 (represented by secondary images 34') to be projected in different orientations, for example, skewed ninety degrees from the image 34 so that viewers can easily view image 34 from a greater variety of positions on the ground. While image 34 may be projected roughly onto a center of surface 36, secondary images 34' may be projected onto a descending curvature 96 of surface 36 of parachute-wing 24 to enhance viewing from a greater lateral distance. In yet another embodiment, the multiple projectors 32 need not project the identical image 34, but alternatively may project different images.

FIG. 6 illustrates a flowchart of an information display process 98 utilizing aerial image projection system 20. Information display process 98 provides generalized service methodology for generating aerial advertising, text, video, still images, webpages, and the like and displaying it on parachute-wing 24 of powered parachute 22. Information display process 98 includes an image generation subprocess 100 and an image display subprocess 102. Information display process 98 may be realized as software that guides an operator through the operations of image generation subprocess 100 and an image display subprocess 102 using, for example, a conventional user interface that allows the operator to interact with on-board projection and computing unit 30 (FIG. 1). Consequently, those skilled in the art will recognize that the process steps discussed below can take on great number of variations and can be performed in a differing order then that which was presented.

In general, image generation subprocess 100 of information display process 98 begins with a task 104. At task 104, an image file is created. An image file containing image 34 (FIG. 1) can be created utilizing a variety of methodologies. These methodologies can include, but are not limited to, taking digital still images, utilizing a digital motion video recording system that uses a digital video signal rather than an analog video signal, creating cartoons and images and converting them to a digital format, taking analog still pictures and saving them in a digital format, and/or filming using an analog recording system and converting it to a digital video signal. In addition, the image file containing image 34 may be created by entry of text and/or by entry of custom messages through a website managed by terrestrial computing system 82 (FIG. 3).

Next a query task 106 is performed. At query task 106, a determination is made as to whether image 34 is to be associated with a target location. When a determination is made that a target location will not be associated with image 34, image generation subprocess 100 continues with a task 108. At task 108, customer identifier 76 (FIG. 4) and an associated image file 80 containing or pointing to image 34 are stored in database 62 (FIG. 4). However when a determination is made at query task 106 that one or more target locations will be associated with image 34, image generation subprocess 100 continues with a task 110. At task 110, one or more waypoints 78 (FIG. 4) are determined for the one or more target locations at which the customer wishes to display image 34.

Image generation subprocess 100 continues with a task 112. At task 108, customer identifier 76 (FIG. 4), an associated image file 80 (FIG. 4) containing or pointing to image 34, and waypoints 78 are stored in database 62. The operations of image generation subprocess 100 can initially be repeated to populate database 62. In addition, database 62 can continually be updated as additional customers register for the services embodied by information display process 98.

Image display subprocess 102 of information display process 98 begins with a task 114. At task 114, support structure 48 (FIG. 2) with on-board projection and computing unit 30 (FIG. 1) is mounted to powered parachute 22 (FIG. 1). For example, support structure 48 with on-board projection and computing unit 30 is coupled to top struts 50 (FIG. 2) of carriage 26 (FIG. 2). Task 114 continues with the pilot flying powered parachute/light aircraft 22 per conventional practices.

Once powered parachute 22 is flying, image display subprocess 102 continues with a task 116. At task 116, database 62 (FIG. 4) is accessed in accordance with some predetermined criteria set by the customer or customers utilizing the services of information display process 98. The predetermined criteria may be time of day, a particular location over an event, waypoint 68 (FIG. 3) detected by navigation system receiver 66 (FIG. 3) for a current location of aerial image projection system (FIG. 1), and/or some combination of predetermined criteria. Database 62 may be accessed without human intervention by processor 52 (FIG. 3) in response to, for example, waypoint 68. Alternatively, database 62 may be accessed through human intervention, such as by the pilot, by a passenger riding in powered parachute 22, or by an operator located at terrestrial computing system 82 (FIG. 3) who may be remotely operating on-board projection and computing unit 30 (FIG. 3).

A task 118 is performed in connection with task 116. At task 118, one of image files 80 (FIG. 4) is selected from database 62 for projection onto parachute-wing 24 (FIG. 1).

Next, a task 120 is performed. At task 120, image 34 (FIG. 1) associated with the selected one of image files 80 is communicated to image projector 32 (FIG. 1) or image projectors 32 (FIG. 5) via, for example, data channel 54 (FIG. 3).

In response to task 120, a task 122 is performed. At task 122, image 34 is projected onto surface 36 (FIG. 1) of parachute-wing 24 (FIG. 3). It should be noted that as image 34 is projected onto surface 36 at task 122, audio 90 may be activated to further capture the attention of audience 94 (FIG. 3).

Image display subprocess 102 of information display process 98 continues with a query task 124. At query task 124, a determination is made as to whether projection of image 34 is to end. A determination may be made to discontinue the projection of image 34 in response to certain predetermined criteria set by the customer or customers utilizing the services of information display process 98. This predetermined criteria may be, for example, projection duration, current location of aerial image projection system 20 (FIG. 1), completion of a particular event over which powered parachute 22 (FIG. 1) is flying, and/or some combination of predetermined criteria. This determination may be made without human intervention by processor 52 (FIG. 3). Alternatively, this determination may be made through human decision making, such as by a passenger riding in powered parachute 22, or by an operator located at terrestrial computing system 82 (FIG. 3) who is remotely operating on-board projection and computing unit 30 (FIG. 3).

When query task 124 determines that projection of image 34 is to continue, process control loops back to task 122 to continue projecting image 34 onto surface 36 of parachute-wing 24. However, when a determination is made at query task 124 that projection of image 34 is to be discontinued, process control proceeds to a query task 126.

At query task 126, a determination is made as to whether another image 34 associated with another one of image files 80 (FIG. 4) is to be projected onto surface 36. Given database 62 (FIG. 4) of image files 80, a pilot may continue to fly powered parachute 22 (FIG. 1) and project other images 34 in accordance with pre-set criteria for certain customers utilizing the services of information display process 98.

When another image 34 is to be projected, process control loops back to task 116 to access database 62, select another one of image files 80 (FIG. 4), communicate image 34 to image projectors 32, and to project the next image 34 onto surface 36 of parachute-wing 24. However, at query task 126, when there are no further images 34 to be projected during the current flight of powered parachute 22, information display process 98 ends. Of course, it should be readily apparent that "ending" process 98 entails landing powered parachute 22, powering down on-board projection and computing unit 30 (FIG. 1), dismounting on-board projection and computing unit 30 from powered parachute 22 if need be, and so forth.

Information display process 98 describes exemplary operations associated with projecting image 34 onto surface 36 of parachute-wing 24. Other operations that may be performed in conjunction with process 98 include activating camera 67 (FIG. 3) and capturing still or moving pictures 89 (FIG. 3) of location 92 (FIG. 3) over which powered parachute 22 may currently be flying. Still further, these captured still or moving pictures 89 may become image 34 projected onto surface 36 of parachute-wing 24 in real- or near real-time.

Embodiments described herein comprise an aerial image projection system and a method using the aerial image projection system for the aerial display of information content that draws significant spectator attention. The aerial image projection system uses light sport aircraft, and more particularly a powered parachute for delivering the aerial display to a particular location. Such a light sport aircraft can be flown "low and slow" in locations that may otherwise be subject to restricted access by other aerial vehicles. An image projected onto an earth-facing surface of a parachute-wing of the powered parachute can be readily seen, especially at night, where towed banners, stitched canopies, and so forth may not be as visible. Through the use of an on-board projection and computing unit, the system can display a variety of still and moving images stored in a digital format. This digital format enables the use of images in a variety of forms, such as company logos, still pictures, text, animated cartoons, video recordings, real-time video images, webpages, and the like. Software and/or operator control enables a versatile system in which different images can be readily projected at various times and in various locations. The use of GPS receiver waypoints to guide image projection allows for the projected information content to change according to any geographical location of the aerial image projection system which is deemed particularly advantageous to the customer. Moreover, the use of aerial image projection system facilitates methodology that is relatively inexpensive by eliminating the larger costs of custom stitched canopies, airships or other inflatable structures with airship displays, and the like.

Although the preferred embodiments of the invention have been illustrated and described in detail, it will be readily apparent to those skilled in the art that various modifications may be made therein without departing from the spirit of the invention or from the scope of the appended claims. For example, the system and methodology may be expanded such that the same or similar information for a single customer can be displayed on multiple powered parachutes in multiple geographic locations. In addition, image projection may be synchronized with video from large-screen television technology (e.g., JumboTron) typically used in sports stadiums and concert venues to show close up shots of the event.

What is claimed is:

1. An aerial image projection system comprising:

a light aircraft having a parachute-wing attached to a carriage; and an image projector suspended below said parachute-wing positioned for projecting an image onto a surface of said parachute-wing while said light aircraft is flying.

2. An aerial image projection system as claimed in claim 1 further comprising a support structure attached to said carriage of said light aircraft, said image projector being coupled to said support structure.

3. An aerial image projection system as claimed in claim 2 wherein said support structure is a variable position mounting system for selectively directing said image to a predetermined location on said surface of said parachute-wing.

4. An aerial image projection system as claimed in claim 1 further comprising multiple image projectors suspended below said parachute-wing, said image projector being one of said multiple image projectors.

5. An aerial image projection system as claimed in claim 4 wherein each of said multiple image projectors are oriented such that said multiple image projectors project said image at different locations and in different orientations on said parachute-wing.

6. An aerial image projection system as claimed in claim 1 further comprising:

a processor in communication with said image projector via a data transfer channel; and a memory element in communication with said processor, said memory element containing a database of image content, said image being stored in said database, and said processor accessing said database to obtain said image for projection via said image projector onto said surface of said parachute-wing.

7. An aerial image projection system as claimed in claim 6 further comprising a navigational system receiver in communication with said processor, said navigational system receiver providing a waypoint to said processor, said waypoint indicating a current location of said aerial image projection system, and said processor accessing said database to select said image for projection when said current location is a target location at which said image is to be projected.

8. An image projection system as claimed in claim 1 further comprising:

a processor in communication with said image projector via a data transfer channel;

a wireless access device in communication with said processor; and a terrestrial computing system in communication with wireless access device via a wireless network, said image being uploadable from said terrestrial computing system to said processor via said wireless access device.

9. An image projection system as claimed in claim 1 further comprising:

a camera having a video output; and a processor in communication with said camera via said video output, said camera capturing a picture of a location over which said light aircraft is flying and communicating said picture to said processor.

10. An image projection system as claimed in claim 9 further comprising:

a wireless access device in communication with said processor; and a terrestrial computing system in communication with wireless access device via a wireless network, said picture being downloadable from said processor to said terrestrial computing system via said wireless access device.

11. An image projection system as claimed in claim 1 further comprising means for providing audio correlated with projection of said image.

12. An image projection system as claimed in claim 11 wherein said means for providing audio is terrestrial-based.

13. A method for projecting an image utilizing an aerial image projection system that includes a light aircraft having a parachute-wing attached to a carriage, said method comprising:

suspending an image projector below said parachute-wing;

flying said light aircraft; and projecting an image from said image projector onto a surface of said parachute-wing while said light aircraft is flying.

14. A method as claimed in claim 13 wherein said image projector is coupled to a variable position mounting system, and said method further comprises adjusting a position of said image projector via said variable position mounting system to selectively direct said image to a predetermined location on said surface of said parachute-wing.

15. A method as claimed in claim 13 wherein said image projector is one of multiple image projectors suspended below said parachute-wing, and said method further comprises orienting each of said multiple image projectors such that said image is projected from said multiple image projectors at different locations and in different orientations on said parachute-wing.

16. A method as claimed in claim 13 wherein said aerial image projection system further includes a processor in communication with said image projector via a data transfer channel and a memory element in communication with said processor, said memory element containing a database of image content, said image being stored in said database, and said method further comprises:

accessing said database to obtain said image for projection, said accessing being performed by said processor; and communicating said image to said image projector via said data transfer channel for projection via said image projector onto said surface of said parachute-wing.

17. A method as claimed in claim 16 wherein said aerial image projection system further includes a navigational system receiver in communication with said processor, and said method further comprises:

providing a waypoint from said navigational system to said processor, said waypoint indicating a current location of said aerial image projection system;

determining that said current location is a target location; and said accessing operation includes selecting said image for projection when said current location is said target location.

18. A method as claimed in claim 13 wherein said aerial image projection system further includes a camera having a video output, a processor in communication with said camera via said video output, a wireless access device in communication with said processor, and a terrestrial computing system in wireless communication with said wireless access device via a wireless network, and said method further comprises:

said camera capturing a picture of a location over which said light aircraft is flying;

communicating said picture from said camera to said processor; and downloading said picture from said wireless access device to said terrestrial computing system via said wireless network.

19. A method as claimed in claim 13 further comprising providing audio correlated with said image, said providing operation occurring concurrent with said projecting operation.

20. An aerial image projection system comprising:

a light aircraft having a parachute-wing attached to a carriage;

a support structure attached to said carriage of said light aircraft;

an image projector coupled to said support structure;

a processor in communication with said image projector via a data transfer channel;

a memory element in communication with said processor, said memory element containing a database of image content, said image content including an image, and said processor accessing said database to obtain said image for projection from said image projector onto a surface of said parachute-wing while said light aircraft is flying; and a navigational system receiver in communication with said processor, said navigational system receiver providing a waypoint to said processor, said waypoint indicating a current location of said aerial image projection system, and said processor accessing said database to select said image for projection when said current location is a target location at which said image is to be projected.

* * * * *